US006348861B1

(12) United States Patent
Li

(10) Patent No.: US 6,348,861 B1
(45) Date of Patent: Feb. 19, 2002

(54) BINARY MULTI-CODE COMBINATION SENSOR

(76) Inventor: Thomas Wing Kawk Li, Flat 7, 10/F., Block B, 11-13 Tai Yuen Street, Kwai Chung, N. T. Hong Kong (CN)

( * ) Notice: Subject to any disclaimer, the term of this patent is extended or adjusted under 35 U.S.C. 154(b) by 0 days.

(21) Appl. No.: 09/591,368

(22) Filed: Jun. 9, 2000

(51) Int. Cl.[7] ..... G08B 13/08
(52) U.S. Cl. ..... 340/547; 340/541
(58) Field of Search ..... 340/541, 545.1, 340/547, 543; 335/205, 206, 207

(56) References Cited

U.S. PATENT DOCUMENTS 4,210,889 A * 7/1980 Holce ..... 335/207
5,233,323 A * 8/1993 Burkett et al. ..... 335/207
5,633,626 A * 5/1997 Cawthorne ..... 340/547 X
5,668,533 A * 9/1997 Jackson, Jr. et al. ..... 340/547

* cited by examiner

*Primary Examiner*—Thomas Mullen
(74) *Attorney, Agent, or Firm*—Alix, Yale & Ristas, LLP

(57) ABSTRACT

A binary multi-code combination sensor employs a magnetically coded transmitter and corresponding receiver to add a level of security to conventional low-security alarm systems. The transmitter includes a pattern of magnetic and non-magnetic portions. The receiver includes a series arrangement of magnetically sensitive switches wherein normally open switches are positioned to be held closed by the magnetic portions of the transmitter and normally closed switches are positioned opposite the non-magnetic portions of the transmitter. Added security is provided by the normally closed switches which open in response to attempted tampering using an external magnetic field. Coded sensors increase the difficulty of successfully defeating the sensor using an external magnetic field.

21 Claims, 4 Drawing Sheets

BINARY MULTI-CODE COMBINATION SENSOR

BACKGROUND OF THE INVENTION

1. Field of the Invention

This invention relates generally to security systems used to secure the windows and doors of building structures against unauthorized entry. In particular, this invention relates generally to magnetically activated sensors used to detect unauthorized opening of windows or doors.

2. The Prior Art

It is known in the art of burglar alarm systems to use magnetically sensitive sensors to detect unauthorized entry. Standard magnetically sensitive sensors known in the art typically have two parts. The first part contains a magnet and is affixed to the moving portion of a window or door. The second part contains a magnetically sensitive switch and is affixed to the stationary part of the building, door jam or window sill. The stationary portion of the sensor is wired to an alarm system which is equipped to detect a change of state of the magnetically sensitive switch. Multiple windows or doors in a given room or area can be wired in a series loop where, when the area is secured, the loop is closed (conductive). If any of the sensors in a secured area are disturbed, the loop becomes open, activating the alarm. Typically, this type of system is used in a low risk level security system such as a typical home burglar alarm system.

Single switch magnetic sensors have the significant disadvantage of being easily defeated by an external magnetic field. A powerful magnetic field placed outside the window or door adjacent to the position of the sensor will hold the magnetically sensitive switch in a closed position even if the window or door is opened, thus defeating the ability of the sensor to detect movement of the window or door.

The sensors previously described are known as a Class 1, or low security level sensor. More sophisticated sensors are used in higher security systems. For example, a Class 2 sensor consists of a reed switch and bias magnet positioned in a receiver and an actuator magnet located in the transmitter. The reed switch is manufactured with the common leg touching the normally closed leg. Installation requires biasing the sensor by carefully positioning the bias magnet to move the common leg of the sensor out of contact with the normally closed wire and into contact with the normally open wire. The actuator magnet is capable of moving the switch back to the normally closed position. This switch is balanced and is held in the operational state only as long as the actuator magnet remains in a specific zone near the switch. If the actuator magnet is moved closer to the switch or further away, the switch becomes unbalanced, causing a change of state. Approaching a Class 2 switch with a magnet of the wrong polarity or of improper strength will cause the switch to change state and trigger the alarm. Class 2 switches offer a medium level of security and are used in commercial, industrial and prison security applications.

Switches of Classes 3–6 are known in the art, each providing a progressively higher level of security, complexity and expense. Class 2 switches, for example, are significantly more expensive than Class 1 switches and require extensive time and sophistication for proper installation and operation, making them impractical for inexpensive low security installations.

SUMMARY OF THE INVENTION

Briefly stated, the invention in a preferred form comprises a multi-combination magnetism transmitter and a multi-code combination sensor. The multi-code combination magnetism transmitter (hereinafter "transmitter") comprises a unit containing magnetic portions and non-magnetic portions arranged in a pattern. The multi-code combination sensor (hereinafter "receiver") comprises multiple magnetically sensitive switches positioned to respond to magnetic fields in the transmitter. In practice, a magnetically sensitive normally open switch is positioned opposite the magnetic field of a magnetic portion in the transmitter. When correctly positioned, the magnetic field will close the magnetically sensitive, normally open switch. A magnetically sensitive normally closed switch is positioned opposite a non-magnetic portion of the transmitter. This normally closed switch will remain closed when it is positioned adjacent to the non-magnetic portion of the transmitter.

A pattern of magnetic and non-magnetic portions of the transmitter correspond to magnetically sensitive normally open and normally closed switches on the receiver, respectively. A matched transmitter and receiver form a sensor which can replace the single switch sensor and magnet of a standard Class I sensor while adding an additional level of security. Added security is provided by the magnetically sensitive normally closed switches. These normally closed switches will respond to an externally applied magnetic field used in an attempt to defeat the sensor.

The pattern of magnetic and non-magnetic portions in the sensor can be arranged in linear fashion where it will create a 'binary' pattern of magnetic and non-magnetic portions. The magnetic, non-magnetic pattern may alternatively be more geometric, forming a grid of magnetic and non-magnetic portions. Whatever the form, the cost and installation complexity of the binary multi-code combination sensor is comparable to a standard Class 1 switch. The binary multi-code combination sensor is a direct replacement for Class 1 switches in existing low security alarm systems.

An object of the present invention is to provide a new and improved binary multi-code combination sensor which cost effectively provides an added level of security to standard burglar alarm systems.

Another object of the present invention is to provide a new and improved binary multi-code combination sensor equipped with multiple tamper detection switches.

These and other objects, features, and advantages of the invention will become readily apparent to those skilled in the art upon reading the description of the preferred embodiments, in conjunction with the accompanying drawings.

DESCRIPTION OF THE PREFERRED EMBODIMENTS

Figure 1:
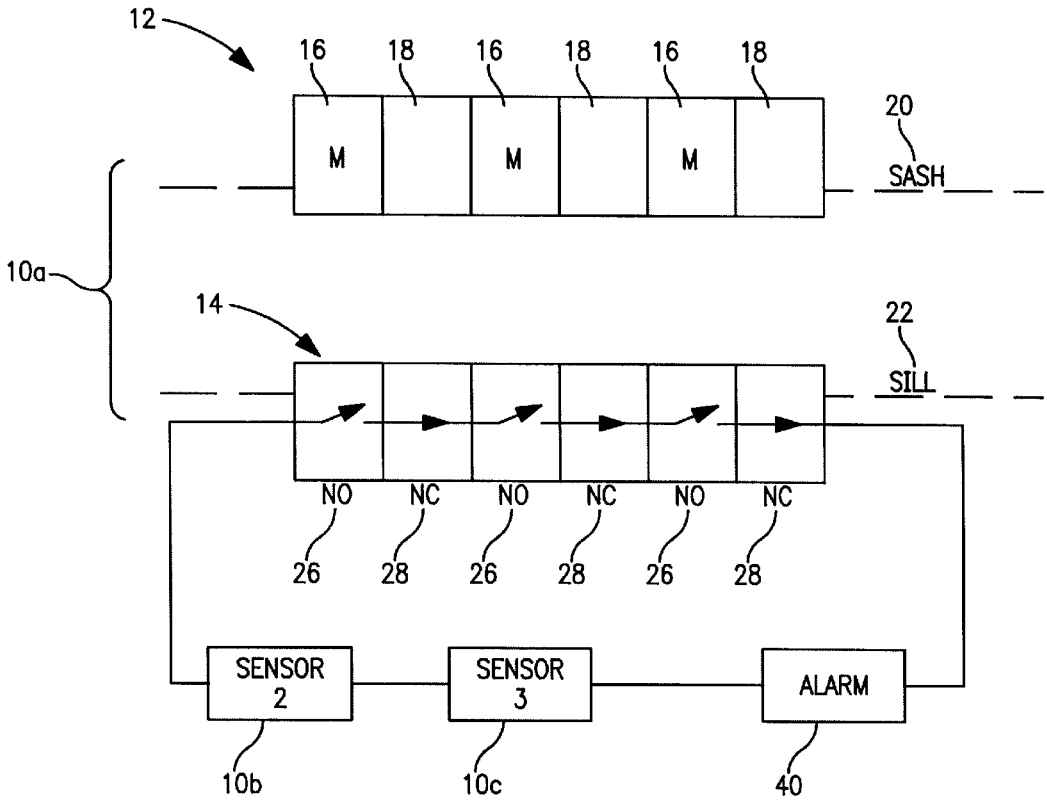
FIG. 1 is a block diagram of an alarm system incorporating a binary multi-code combination sensor in accordance with the present invention.
Figure 2:
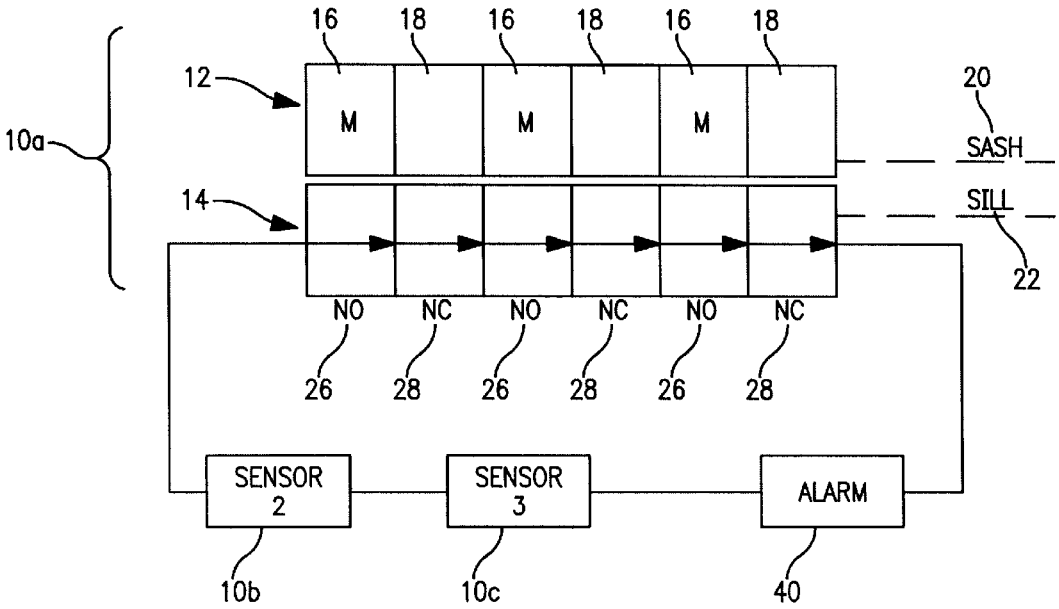
FIG. 2 is a block diagram of the alarm system of FIG. 1, illustrating the binary multi-code combination sensor in an installed configuration.
Figure 3:
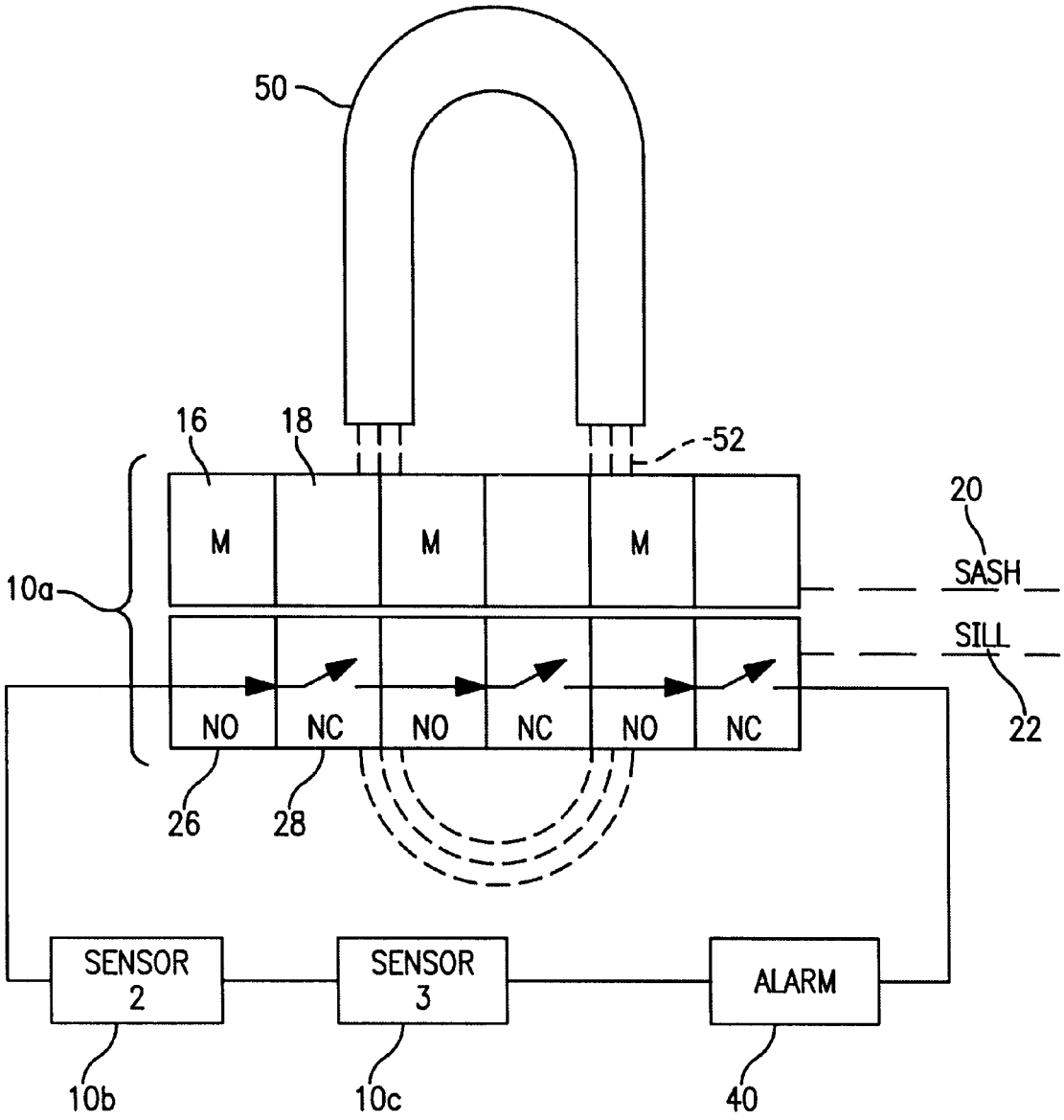
FIG. 3 is a block diagram of the alarm system of FIG. 1, schematically illustrating the binary multi-code combination sensor configuration in response to an exterior magnetic field.

FIGS. 1–3 are simplified illustrations of an alarm system incorporating a six digit binary multi-code combination sensor in accordance with the present invention. In a preferred form, the binary multi-code combination sensor comprises a multi-code magnetism transmitter 12 (hereinafter "transmitter") and a multi-code combination sensor 14 (hereinafter "receiver"). The transmitter 12 comprises a unit containing magnetic portions 16 and non-magnetic portions 18 arranged in a pattern. The sensor 14 comprises a pattern of two types of magnetically sensitive switch. The magnetically sensitive switches are typically reed-type switches, but any switch which reliably reacts when exposed to a magnetic field is appropriate.

A magnetically sensitive normally open switch 26 is constructed to be normally open but may be held in a closed position by the presence of a magnetic field. The normally closed switches 28 are also magnetically sensitive but are constructed to remain closed in the absence of a magnetic field. In accordance with one aspect of the invention, the normally closed switches 28 may have a greater sensitivity to magnetic fields than the normally open switches 26. The two types of switches 26, 28 are arranged in a pattern corresponding to the pattern of magnetic portions 16 and non-magnetic portions 18 in the transmitter 12. As can be seen from FIG. 1, the normally open switch 26 is positioned opposite a magnetic portion 16, whereas normally closed switch 28 is positioned opposite a non-magnetic portion 18.

As is typical with such installations, the transmitter 12 is affixed to the moving part of a window or door, in this case the sash 20 of a window. The receiver 14 is affixed to the stationary part of a window or door, in this case the sill 22 of a window. FIG. 1 illustrates the positions of the switches in the receiver 14 with the window sash 20 in a raised or open position. When the window is open, the transmitter 12 is too far away to influence the positions of the magnetically sensitive switches in the receiver 14. Therefore, the normally open switches 26 are in their normally open position and the normally closed switches 28 are in their closed position. In this condition, there is no continuity through the receiver 14 due to the open configuration of the normally opened switches in the first, third and fifth portions.

Of course it is possible and within the skill in the art to reverse the position of the transmitter 12 and receiver 14 so that the transmitter is fixed to the moving part and the receiver is fixed to the stationary part of the window or door.

FIG. 1 illustrates the other components of a simple alarm system in block form. An alarm module 40 is equipped to monitor a sensor loop including binary multi-code combination sensors 10*a,* 10*b* and 10*c*. The alarm module 40 is equipped to detect a change of state in any of the switch portions 26, 28 of the receivers 14.

FIG. 2 illustrates the switch configurations in the receiver 14 when the sash has been lowered to bring the transmitter 12 in close proximity to the receiver 14. When the sash 20 is lowered, the magnetic portions 16 of the transmitter 12 are brought close enough to the normally open portions 26 of the receiver 14 to hold the normally open switches 26 in a closed and conductive position. Assuming sensors 10*b* and 10*c* are also closed, the loop including sensors 10*a,* 10*b* and 10*c* will present a continuous (conductive) loop to the alarm module 40. In the configuration illustrated in FIG. 2, the alarm could be armed. Thereafter, if any of the three sensors 10*a,* 10*b,* 10*c* are disturbed to the extent that their receiver switches change state, the loop will no longer be continuous and the alarm will be triggered. A typical alarm system will have multiple such loops, each loop protecting rooms or floors, or portions of a building from unauthorized entry.

FIG. 3 illustrates the alarm system of FIGS. 1 and 2 with the sash lowered as illustrated in FIG. 2 with the added element of an attempt to defeat sensor 10*a* by use of an externally applied magnetic field 52 from horseshoe magnet 50. An externally applied magnetic field is the most common method of defeating a low security or Class 1 type of sensor. The normally open switches 26 are still held in their closed position by the magnetic portions of the transmitter 12 affixed to the closed window sash 20. If only one magnetically sensitive normally open switch 26 were used in the sensor, as is typical, the externally applied magnetic field 52 would hold the normally open switch 26 in a closed position even after the sash 20 had been raised.

A binary multi-code combination sensor 10*a* in accordance with the present invention avoids defeat by incorporating magnetically sensitive normally closed switch portions 28. An externally applied magnetic field 52 will cause the magnetically sensitive normally closed switch portions 28 to open, changing the state of the receiver 14 from conductive to non-conductive and triggering the alarm module 40. An externally applied magnetic field 52 may not open all the normally closed portions 28 of a receiver 14 as illustrated in FIG. 3. However, only one portion 28 needs to open to change the state of the receiver and trigger the alarm 40.

Figure 4:
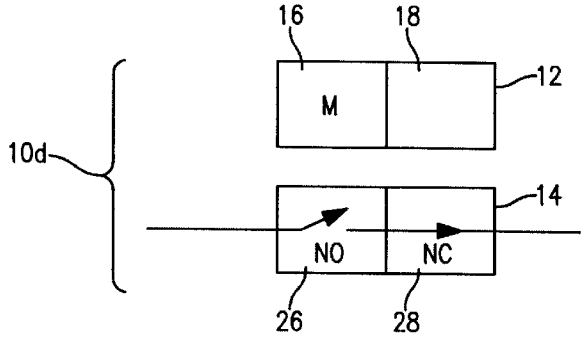
FIG. 4 is a schematic representation of a two digit binary multi-code combination sensor in accordance with the present invention.
Figure 5:
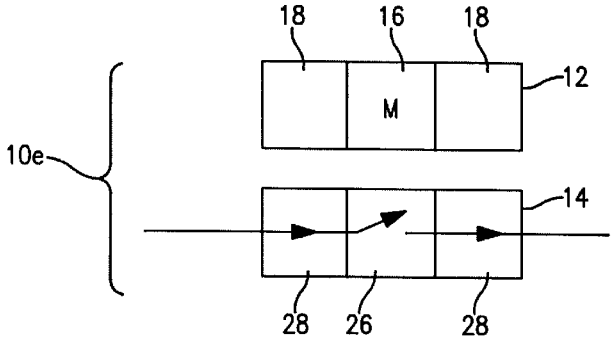
FIG. 5 is a schematic representation of a three digit binary multi-code combination sensor in accordance with the present invention.

FIG. 4 illustrates a two digit binary multi-code combination sensor. Sensor 10*d* comprises a transmitter having one magnetic portion 16 and one non-magnetic portion 18. Switch portions 26 and 28 are positioned to respond to the arrangement of transmitter portions 16 and 18. FIG. 5 illustrates a three digit binary multi-code combination sensor 10*e*. Increasing the number of digits in the binary multi-code combination sensor allows the pattern of magnetic and nonmagnetic portions to be varied, creating a multitude of combinations which can be used to match transmitters 12 with receivers 14.

It should be noted that, no matter how many portions are used in the binary multi-code combination sensor, the pattern of all normally open or all normally closed switches must be eliminated for the practical reasons that the former does not improve security over the prior art, while the latter would only detect an externally applied magnetic field and would have no way of detecting the condition of the door or window to which it is applied. For example, in the case of the two digit binary multi-code combination sensor 10*d,* there are two possible patterns. The first pattern is illustrated in FIG. 4 wherein the left hand switch portion is magnetically sensitive and the left hand transmitter portion is magnetic. The alternative pattern is a mirror image of the configuration illustrated in FIG. 4.

An increase from tow switch portions and two transmitter portions to three switch portions and three transmitter portions results in six possible combinations, an increase to four switch portions and four transmitter portions result in fourteen possible combinations and so on. Matched transmitters and receivers having three or more switch portions resist tampering by providing multiple patterns of switch and magnetic portions. Defeat of such a sensor may only be accomplished using a device which will accurately reproduce both the pattern and the relative intensity of the magnetic portions of the transmitter 12. This is extremely difficult because magnetic fields fade quickly as the distance between the magnet and the object to be influenced increases. As a result, a magnet powerful enough to hold the normally open switch portions 26 in a closed position is very likely to open the normally closed switch portions 28.

Figure 6:
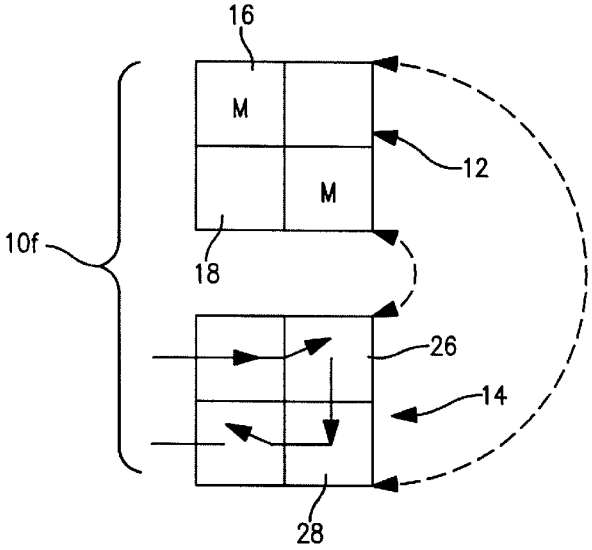
FIG. 6 is a schematic representation of a grid pattern four digit binary multi-code combination sensor in accordance with the present invention.
Figure 7:
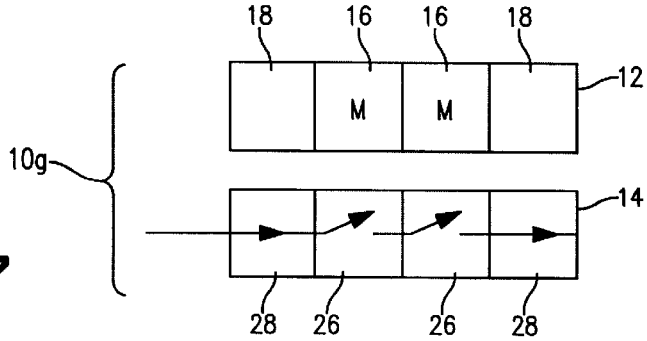
FIG. 7 is a schematic representation of an in line four digit binary multi-code combination sensor in accordance with the present invention.

FIGS. 6 and 7 illustrate alternative configurations of a four digit binary multi-code combination sensor 10*f*. FIG. 6 illustrates a grid pattern in which receiver switch portions 26 and 28 are arranged in two rows of two, one over the other. The magnetic portions of the transmitter 12 are arranged in a corresponding pattern. The switch portions 26, 28 are still arranged in series within the receiver 14.

Figure 8:
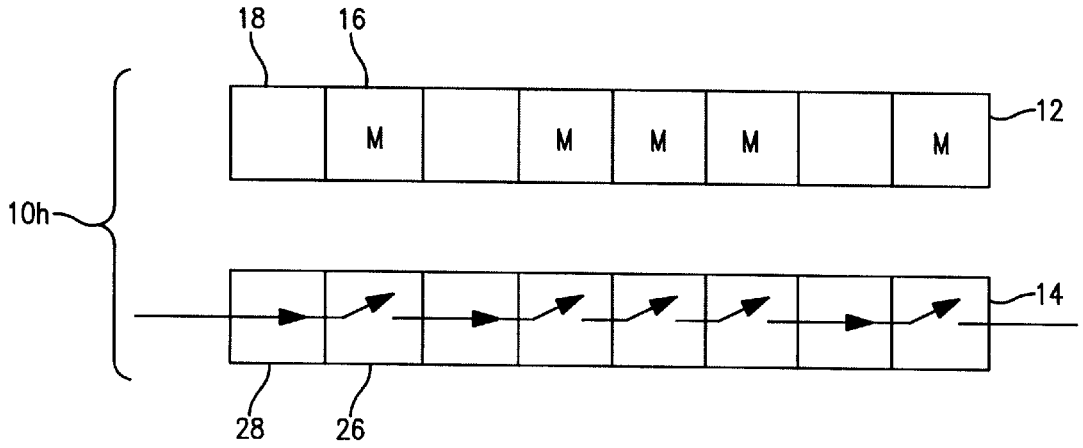
FIG. 8 is a schematic representation of an eight digit binary multi-code combination sensor in accordance with the present invention.
Figure 9:
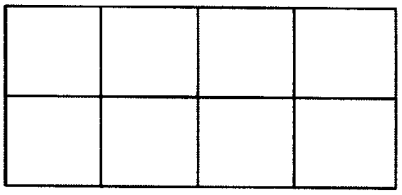
FIGS. 9–11 are line drawings of alternative configurations of an eight digit binary multi-code combination sensor in accordance with the present invention.
Figure 11:
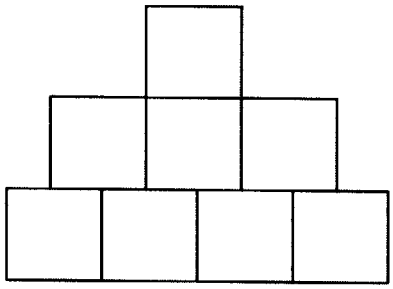
Figure 10:
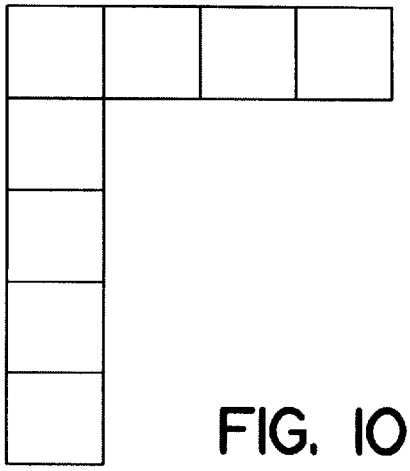

FIG. 7 illustrates a simple linear pattern for a four digit binary multi-code combination sensor 10*g*. FIG. 8 illustrates an eight digit binary multi-code combination sensor. As the number of digits in a binary multi-code combination sensor increases, the corresponding length of a linear arrangement of portions may increase beyond what is practical for a particular application. Alternative configurations of the eight switch and magnetic portions of an eight digit binary multi-code combination sensor are illustrated in FIGS. 9–11. Any of these alternative configurations may be used to alleviate space constraints and/or to suit a particular application.

A binary multi-code combination sensor in accordance with the present invention resists tampering in two ways. First, the magnetically sensitive normally closed switch portions will open in response to the externally applied magnetic fields typically used to defeat such sensors. Second, the pattern of normally open and normally closed switches in the receiver can vary in accordance with the number of digits. Even a sophisticated burglar can never be sure what the pattern of switches will be, making defeat of a multi-portion binary multi-code combination sensor unlikely.

While preferred embodiments of the foregoing invention have been set forth for purposes of illustration, the foregoing descriptions should not be deemed a limitation of the invention herein. Accordingly, various modifications, adaptations, and alternatives may occur to one skilled in the art without departing from the spirit and the scope of the present invention.

What is claimed is:

1. A binary multi-code combination sensor for use in combination with an alarm system, said sensor comprising:

a magnetic transmitter including a plurality of magnetic and non-magnetic portions, and a receiver including a series arrangement of magnetically sensitive switches, said arrangement having a normally open switch corresponding to each magnetic transmitter portion and a magnetically sensitive normally closed switch corresponding to each non-magnetic transmitter portion, wherein said transmitter and said receiver are movable with respect to each other and said series arrangement is conductive when said transmitter is immediately adjacent to and aligned with said receiver and not conductive when said transmitter is not immediately adjacent to and aligned with said receiver and said magnetically sensitive normally closed switches open in response to an externally applied magnetic field of sufficient strength to influence the position of said magnetically sensitive normally open switches.

2. The sensor of claim 1, wherein said magnetically sensitive switches are reed switches.

3. The sensor of claim 1, wherein said sensor is installed on a building with the transmitter attached to a movable portion of the building which covers an opening into or within the building and the receiver is attached to a fixed part of the building adjacent to the position of the transmitter when said movable portion is positioned to close said opening.

4. The sensor of claim 1, wherein said sensor is installed on a building with the receiver attached to a movable portion of the building which covers an opening into or within the building and the transmitter is attached to a fixed part of the building adjacent to the position of the receiver when said movable portion is positioned to close said opening.

5. The sensor of claim 1, wherein the number of magnetic and nonmagnetic portions is selected from the group consisting of: 2, 3, 4, 5, 6, 7, or 8.

6. The sensor of claim 1, wherein the magnetic and non-magnetic portions of the transmitter are arranged in a linear pattern and the magnetically sensitive switches in said receiver are arranged in a corresponding linear pattern.

7. The sensor of claim 1, wherein the magnetic and non-magnetic portions of the transmitter are arranged in a non-linear pattern and the magnetically sensitive switches in said receiver are arranged in a corresponding non-linear pattern.

8. The sensor of claim 1, wherein the normally closed switches have a greater sensitivity to magnetic fields than the normally open switches.

9. An alarm system comprising:

a plurality of sensors, each sensor comprising:

a transmitter including a plurality of magnetic and non-magnetic portions; and a receiver including a series arrangement of magnetically sensitive switches, said arrangement having a normally open switch corresponding to each magnetic transmitter portion and a magnetically sensitive normally closed switch corresponding to each non-magnetic transmitter portion, wherein said transmitter and said receiver are movable with respect to each other and said series arrangement is conductive when said transmitter is immediately adjacent to and aligned with said receiver and not conductive when said transmitter is not immediately adjacent to and aligned with said receiver and said magnetically sensitive normally closed switches open in response to an externally applied magnetic field of sufficient strength to influence the position of said magnetically sensitive normally open switches and said plurality of said sensors are connected in a series loop; and an alarm module sensitive to the continuity of said loop, said alarm module connected to said loop so that opening of any switch in any sensor will trigger the alarm.

10. The alarm system of claim 9, wherein said magnetically sensitive switches are reed switches.

11. The alarm system of claim 9, wherein said sensor is installed on a building with the transmitter attached to a movable portion of the building which covers an opening into or within the building and the receiver is attached to a fixed part of the building adjacent to the position of the transmitter when said movable portion is positioned to close said opening.

12. The alarm system of claim 9, wherein said sensor is installed on a building with the receiver attached to a movable portion of the building which covers an opening into or within the building and the transmitter is attached to a fixed part of the building adjacent to the position of the receiver when said movable portion is positioned to close said opening.

13. The alarm system of claim 9, wherein the magnetic and nonmagnetic portions of the transmitter are arranged in a linear pattern and the magnetically sensitive switches in said receiver are arranged in a corresponding linear pattern.

14. The alarm system of claim 9, wherein the magnetic and nonmagnetic portions of the transmitter are arranged in a non-linear pattern and the magnetically sensitive switches in said receiver are arranged in a corresponding non-linear pattern.

15. The alarm system of claim 9, wherein the normally closed switches have a greater sensitivity to magnetic fields than the normally open switches.

16. A sensor loop for an alarm system comprising:

a plurality of sensors, each sensor comprising:

a transmitter including a plurality of magnetic and non-magnetic portions, said magnetic and non-magnetic portions arranged in a first pattern; and a receiver including a second pattern of magnetically sensitive switches, said second pattern having a normally open switch alignable with each magnetic transmitter portion and a magnetically sensitive normally closed switch alignable with each non-magnetic transmitter portion, said magnetically sensitive switches connected in a series arrangement;

wherein said transmitter and said receiver are movable with respect to each other, said series arrangement is conductive when said transmitter is immediately adjacent to and aligned with said receiver and not conductive when said transmitter is not immediately adjacent to and aligned with said receiver and said magnetically sensitive normally closed switches open in response to an externally applied magnetic field of sufficient strength to influence the position of said magnetically sensitive normally open switches, and said plurality of said sensors are connected in series to form said sensor loop, the first pattern of at least one sensor being different from the corresponding first pattern of the other sensors in the loop.

17. The sensor loop of claim 16, wherein said first pattern of each sensor is different from the corresponding first pattern of the other sensors in the loop.

18. The sensor loop of claim 16, wherein the magnetically sensitive switches are reed switches.

19. The sensor loop of claim 16, wherein the normally closed switches have a greater sensitivity to magnetic fields than the normally open switches.

20. The sensor loop of claim 16, wherein each sensor is installed on a building with the transmitter attached to a movable portion of the building which covers an opening into or within the building and the receiver is attached to a fixed part of the building adjacent to the position of the transmitter when said movable portion is positioned to close said opening.

21. The sensor loop of claim 16, wherein each sensor is installed on a building with the receiver attached to a movable portion of the building which covers an opening into or within the building and the transmitter is attached to a fixed part of the building adjacent to the position of the receiver when said movable portion is positioned to close said opening.

* * * * *